US009552689B2

(12) United States Patent
Walther et al.

(10) Patent No.: US 9,552,689 B2
(45) Date of Patent: Jan. 24, 2017

(54) SYSTEMS AND METHODS FOR DISSEMINATING INFORMATION IN A GAMING ENVIRONMENT

(75) Inventors: Stephen J. Walther, Las Vegas, NV (US); Lael Berelowitz, Las Vegas, NV (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 0 days.

(21) Appl. No.: 13/413,611

(22) Filed: Mar. 6, 2012

(65) Prior Publication Data

US 2012/0258792 A1 Oct. 11, 2012

Related U.S. Application Data

(63) Continuation of application No. 11/838,002, filed on Aug. 13, 2007, now abandoned.

(Continued)

(51) Int. Cl.
*G07F 17/34* (2006.01)
*G07F 17/32* (2006.01)

(52) U.S. Cl.
CPC ..... *G07F 17/3227* (2013.01); *G07F 17/32* (2013.01); *G07F 17/3258* (2013.01); *G07F 17/3276* (2013.01)

(58) Field of Classification Search
CPC ..... G07F 17/32; G07F 17/3232; G07F 17/34; G07F 17/3262; G07F 17/3244; G07F 17/3227; G07F 17/3255; G07F 17/3258; G07F 17/3267; G07F 17/3272; G07F 17/3283; A63F 13/12

(Continued)

(56) References Cited

U.S. PATENT DOCUMENTS 6,942,574 B1 9/2005 LeMay et al.
7,607,976 B2 * 10/2009 Baerlocher et al. ..... 463/16

(Continued)

FOREIGN PATENT DOCUMENTS

JP 2004-305575 A 11/2004

OTHER PUBLICATIONS

International Search Report, PCT/US07/75834, mailed Aug. 27, 2008.

*Primary Examiner* — Damon Pierce
(74) *Attorney, Agent, or Firm* — Armstrong Teasdale LLP

(57) ABSTRACT

Certain embodiments provide systems and methods for awarding jackpots and disseminating information regarding jackpot awards in a gaming environment. Certain embodiments provide a method for announcing jackpot awards including detecting a jackpot awarded at a gaming terminal in the gaming system, determining satisfaction of an announcement criterion by the jackpot, and transmitting, upon satisfaction of the announcement criterion, a jackpot announcement to a group of one or more players satisfying an eligibility criterion. The jackpot announcement may include, for example, an opportunity to win an additional jackpot and/or an award of an additional jackpot. In certain embodiments, the announcement criterion identifies a jackpot sufficient to trigger a jackpot announcement and opportunity for an additional jackpot award. In certain embodiments, the eligibility criterion identifies one or more groups of one or more players who qualify for an opportunity for an additional jackpot.

7 Claims, 15 Drawing Sheets

Related U.S. Application Data

(60) Provisional application No. 60/822,196, filed on Aug. 11, 2006, provisional application No. 60/822,201, filed on Aug. 11, 2006.

(58) Field of Classification Search
USPC .. 463/16, 20, 25, 42, 26, 27, 40; 705/14.12; 714/726
See application file for complete search history.

(56) References Cited

U.S. PATENT DOCUMENTS

| | | | | |
|---|---|---|---|---|
| 7,976,390 | B2 * | 7/2011 | Schneider et al. | 463/42 |
| 2004/0072618 | A1 | 4/2004 | Bartholomew et al. | |
| 2004/0127284 | A1 | 7/2004 | Walker et al. | |
| 2005/0054430 | A1 * | 3/2005 | Pitman et al. | 463/25 |
| 2005/0096125 | A1 | 5/2005 | LeMay et al. | |
| 2005/0119052 | A1 | 6/2005 | Russell et al. | |
| 2005/0215314 | A1 * | 9/2005 | Schneider et al. | 463/26 |
| 2007/0106553 | A1 * | 5/2007 | Jordan et al. | 705/14 |
| 2007/0293292 | A1 * | 12/2007 | Gipp et al. | 463/16 |

* cited by examiner

FIG. 10

RESERVATION MENU

1. TICKET FOR SHOW

2. RESTAURANT RESERVATION

3. VALET CAR SERVICE

4. OTHER

FIG. 11

SHOW TICKET RESERVATION MENU

1. COMEDY
2. MUSICAL
3. MAGIC
4. VARIETY
5. DANCE
6. OTHER

FIG. 12

118

COMEDY RESERVATION MENU

1. SHOW X
2. SHOW Y
3. SHOW Z
4. OTHER

FIG. 13

118

SHOW X RESERVATION MENU
LOCATION: MGM GRAND (ADDRESS)

| DATES | TIMES | | |
|---|---|---|---|
| 1. AUG. 3 | 3PM | 5PM | 8PM |
| 2. AUG. 4 | 3PM | 5PM | 8PM |
| 3. AUG. 5 | 3PM | 6PM | 9PM |
| 4. AUG. 7 | 3PM | 5PM | 8PM |
| 5. AUG. 8 | 3PM | 5PM | 8PM |
| 6. AUG. 9 | 3PM | 5PM | 8PM |
| 7. OTHER | | | |

NUMBER OF TICKETS
1 2 3 4 5 6 7 8 9 10
OTHER __

FIG. 16

118

PERSONAL MESSAGE MENU

1. SEND TO THE FOLLOWING PERSON(S):

2. SEND TO LOCATION OR PLAYER ID NUMBER:

3. CONTENT OF MESSAGE:

FIG. 17

118

180

182

| | | | | | | | | | | |
|---|---|---|---|---|---|---|---|---|---|---|
| 1 | 2 | 3 | 4 | 5 | 6 | 7 | 8 | 9 | 0 | ← |
| Q | W | E | R | T | Y | U | I | O | P | EN-TER |
| A | S | D | F | G | H | J | K | L | : ; | " ' |
| Z | X | C | V | B | N | M | < , | > . | ? / | SHI-FT |

TO: JOHN DOE
LOCATION OR ID: 106
CONTENT: MEET ME AT THE RESERVATION DESK AT NOON.

FIG. 18

118A

I NEED:
1. PERSONAL SERVICE
2. RESERVATION
3. PERSONAL MESSAGE SENT.

MESSAGE CENTER
FROM: JOHN SMITH
DATE: AUG. 5, 2001 TIME: 10:14 AM
MESSAGE:

MEET ME AT THE RESERVATION DESK AT NOON

1. REPLY
2. NO REPLY

FIG. 19

118A

REPLY MESSAGE MENU

1. SEND REPLY TO JOHN SMITH:
2. CC TO LOCATION OR ID:

_____

3. CONTENT OF REPLY:

_____

_____

FIG. 20

134

SERVICE WORKSTATION MESSAGES

| SERVICE NEEDED | LOCATION | TIME IN |
|---|---|---|
| 1. REG. COKE | #102 | 10:45AM |
| 2. DIET COKE | #104 | 11:02AM |

FIG. 21

134

SERVICE WORKSTATION REPLY MESSAGE MENU

1. SEND MESSAGE TO #102
2. CONTENT OF MESSAGE:

_____

_____

SYSTEMS AND METHODS FOR DISSEMINATING INFORMATION IN A GAMING ENVIRONMENT

RELATED APPLICATIONS

The present application is a continuation of U.S. Ser. No. 11/838,002, filed Aug. 13, 2007 now abandoned, which claims priority from U.S. Provisional Application No. 60/822,196, filed on Aug. 11, 2006, entitled "Systems and Methods for Disseminating Information in a Gaming Environment," and U.S. Provisional Application No. 60/822,201, filed on Aug. 11, 2006, entitled "Systems and Methods for Servicing Players in a Gaming Environment," all of which are incorporated herein in their entirety by reference.

FIELD OF THE INVENTION

This invention relates to gaming systems, and more particularly relates to communications with gaming locations and gaming service stations.

BACKGROUND OF THE INVENTION

A large casino typically employs thousands of gaming locations that include non-machine games and machine games. Users of the games typically desire to place orders or reservations as they play, and they may desire to exchange messages with other users. Messaging systems used in casinos in the past have failed to provide such capability. For example, U.S. Pat. No. 5,429,361 (Raven et al., issued Jul. 4, 1995), describes a 12 character dot-matrix LED display 30 that can display messages to a player and a keypad that the player can use to send messages to a control unit. However, the system is not sufficiently interactive and flexible to allow users to efficiently place orders or reservations or to exchange messages.

U.S. Pat. No. 5,951,397 (Dickinson, issued Sep. 14, 1999) and U.S. Pat. No. 6,210,279 (Dickinson, issued Apr. 3, 2001) each discloses a touch screen used in a gaming machine. However, the touch screens are CRTs and are used for operation of the game. Such screens would be too large for effective use in a messaging system suitable for coupling to a gaming machine. U.S. Pat. No. 6,712,98 (Paulsen) also discloses a simple touch screen player tracking interface.

In relation to announcement of events such as jackpots, it has been known to announce over casino public address systems, jackpots which have been won by players. This is typically done for large jackpots. Announcement of jackpots is believed to instill good will and entice other players to also play in hopes that they, too, would hit a jackpot. It is also know for gaming machines to post jackpots such as progressive jackpots on large video displays. Players can see the jackpots they are playing for. When a jackpot is awarded players would know by the re-setting of the jackpot to the seed, starting amount. In other words, if a progressive jackpot is at $26,500 and has a starting value of $10,000, when the jackpot is awarded the display would show the jackpot dropping to $10,000. This would "announce" to players that the jackpot has been awarded.

A drawback with current and prior jackpot announcements is that it requires workers to recognize and announce the jackpots. Often, due to other duties, announcements are not made or are made well after the jackpot has been awarded. Another drawback is that the announcement, the trigger for the announcement and the target clients for the announcement cannot be easily configured. It would be desirable to be able to automate and configure the announcement triggers, audience and the announcement type. In this fashion certain celebration announcements can be configured and selected, different triggers can be defines and the audience—clients to receive the announcement can be targeted.

BRIEF SUMMARY OF THE INVENTION

Certain embodiments provide systems and methods for announcing jackpot awards including detecting a jackpot awarded at a gaming terminal in the gaming system, determining satisfaction of an announcement criterion by the jackpot, and transmitting, upon satisfaction of the announcement criterion, a jackpot announcement to a configurable group of one or more client—players satisfying an eligibility criterion. The jackpot announcement may include, for example, an opportunity to win an additional jackpot and/or an award of an additional jackpot. In certain embodiments, the announcement criterion identifies a jackpot sufficient to trigger a jackpot announcement and opportunity for an additional jackpot award. In certain embodiments, the eligibility criterion identifies one or more groups of one or more client—players who qualify for an opportunity for an additional jackpot.

Certain embodiments provide, in a gaming system having one or more gaming devices for play by players, a method for announcing awards. The method includes detecting an award at a gaming device in the gaming system; determining satisfaction of an announcement criterion by the award; and transmitting, upon satisfaction of the announcement criterion, an award announcement to a configurable group of one or more client-players satisfying an eligibility criterion.

Certain embodiments provide a gaming system in communication with one or more gaming devices for play by players. The system includes an award monitor configured to detect an award at a gaming device in the gaming system. The award monitor determines satisfaction of an announcement criterion by the award. The system also includes an announcer transmitting, upon satisfaction of the announcement criterion, an award announcement to a group of one or more players satisfying an eligibility criterion.

Certain embodiments provide a computer-readable medium having a set of instructions for execution on a processor. The set of instructions includes an award monitoring routine configured to detect an award at a gaming device. The award monitoring routine determines satisfaction of an announcement criterion by the award. The set of instructions also includes an announcement routine transmitting, upon satisfaction of the announcement criterion, an award announcement to a group of one or more players satisfying an eligibility criterion.

BRIEF DESCRIPTION OF THE DRAWINGS

FIG. 10 is a block diagram of the message display shown in FIG. 1 with a reservation menu, including a ticket for show option, displayed in response to selection of the reservation option shown in FIG. 6.

FIG. 11 is a block diagram of the message display shown in FIG. 1 with a show ticket reservation menu, including a comedy option, displayed in response to selection of the ticket for show option shown in FIG. 10.

FIG. 12 is a block diagram of the message display shown in FIG. 1 with a comedy reservation menu, including a show x option, displayed in response to selection of the comedy option shown in FIG. 11.

FIG. 13 is a block diagram of the message display shown in FIG. 1 with a show x reservation menu displayed in response to selection of the show x option of FIG. 12.

FIG. 16 is a block diagram of the message display shown in FIG. 1 with a personal message menu displayed in response to selection of the personal message option shown in FIG. 6.

FIG. 17 is a block diagram of the message display shown in FIG. 1 with an image of a touch screen alphanumeric keypad displayed in response to at least one of options 1, 2 or 3 shown in FIG. 16.

FIG. 18 is a block diagram of a second message display shown in FIG. 1 illustrating delivery of the personal message shown in FIG. 16.

FIG. 19 is a block diagram of the second message display shown in FIG. 18 with a reply message menu.

FIG. 20 is a block diagram of the service center display shown in FIG. 1 with exemplary messages received at the service center.

FIG. 21 is a block diagram of the service center display shown in FIG. 20 with an exemplary reply menu.

Figure 1:
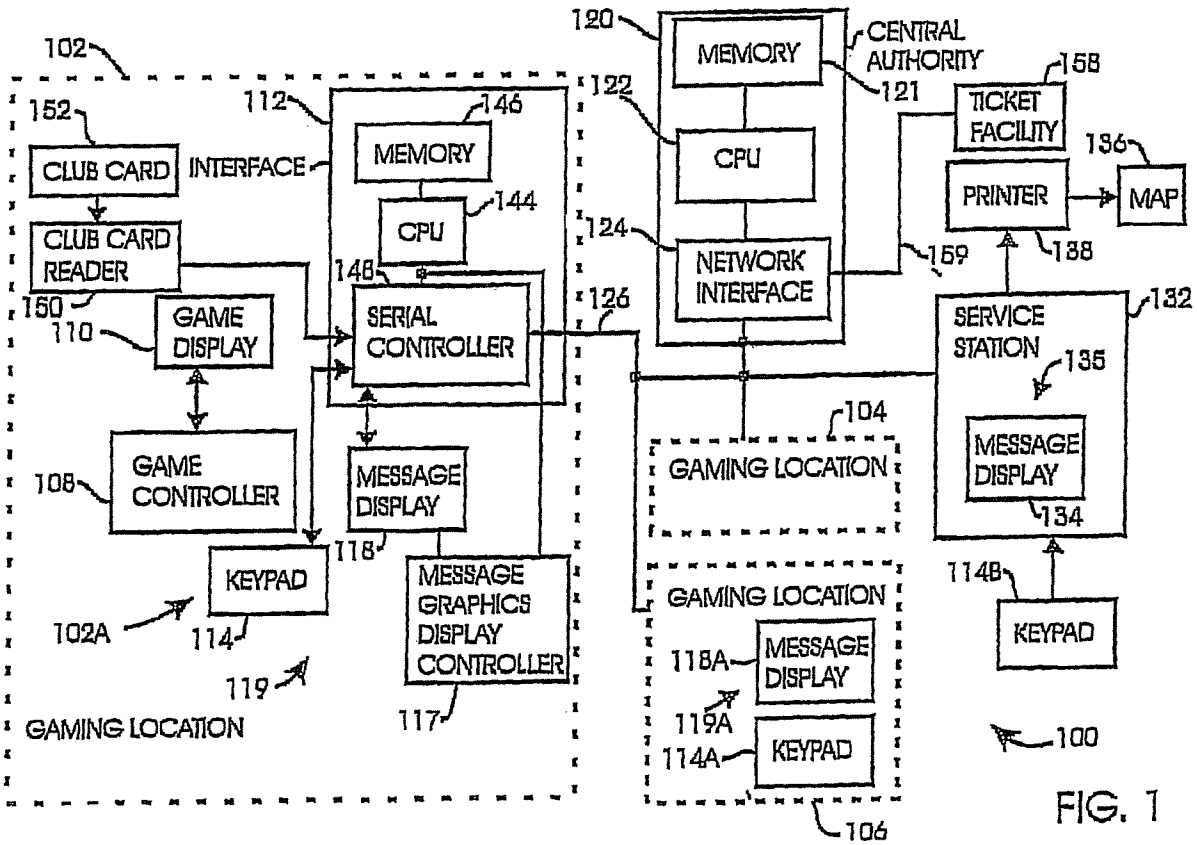
FIG. 1 is a schematic block diagram of one form of gaming system employing a gaming location message display made in accordance with one form of the invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to FIG. 1, gaming system 100 includes a several gaming locations 102, 104 and 106 that may include various non-machine games, such as table games such as craps, Blackjack, Bacarrat or Pai Gow, or may include game machines, such as slot machines, video poker machines, video roulette machines, and the like. It should be understood that, while the present description may refer to "slot" or video poker gaming machines or terminals, gaming tables such as Blackjack, Pai Gow, Baccarat, multi-terminal gaming machines such as multi-terminal roulette, Sik Bo, Poker, dice games, and others may also be included. As an example, a gaming table layout may be embodied as a video display and/or connected to an electronic communication network. Thus, gaming location as used herein includes gaming tables as well as gaming terminals or machines.

Gaming location 102 is exemplary of gaming locations 104 and 106. If gaming location 102 includes a gaming machine 102A, a game controller 108 and a game display 110 are provided. For both a non-machine gaming location and a game machine location, a location interface 112, an optional alphanumeric keypad 114 and a touch screen message display 118 are provided. Display 118 may comprise a touch screen liquid crystal display (LCD) similar to the displays used in laptop computers, for example. Display 118 is coupled to or located inside the cabinet of gaming machine 102A. Using an LCD inside a gaming machine in order to display graphics images and to display a numeric or alphabetic input image is advantageous because it eliminates the need for a separate keypad for the interactive entry of data. In addition, an LCD requires less space than many other types of displays. An optional alphanumeric keypad 114 may be placed for convenient manipulation while a player is using gaming location 102.

A conventional graphics display controller 117 controls display 118. Controller 117 can display either vector graphics or bit-mapped graphics on display 118, depending the type of application program stored in memory 146 used for graphic display and the type of data stored for purposes of generating graphics images. The image data resulting in graphics images can be stored in memory 146 or can be stored in memory 121 and transmitted via network 126 to controller 117 for a particular graphic image. The image data can be either vector data or bit-mapped data. CPU 144 controls the transfer of the image data to controller 117 in response to application programs stored in memory 146 that determine the location of the graphics images on display 118 and also determine the time at which the graphics displays are presented.

Interface 112, optional keypad 114, controller 117 and display 118 comprise an interactive communication unit 119. Each of the gaming locations 104 and 106 include an interactive communication unit like unit 119. For example, gaming location 106 includes a communication unit 119A like unit 119. In one embodiment, a player enters alphabetic and numeric information by touching display 118. In such an embodiment, keypad 114 may not be provided. For the non-machine gaming locations, interface 112 comprises a communication controller 148, such as a modem.

In this specification and claims, interactive indicates being capable of accepting input from a human. Communication unit 119 comprises one or more programs for accepting such input from, for example, a touch screen alphanumeric keyboard image. Such programs are well known to those skilled in computer communication.

For a game machine location, interface 112 may include, for example, an RS485 interface such as that implemented by a Sentinel™ Interface from Aristocrat Technologies Inc. Other interfaces and network architectures (e.g., Ethernet, parallel port, and the like) may be substituted however. Furthermore, interface 112 may implement, for example, the IGT Gaming SAS™ communication protocol or the CDS GDAP™ communication protocol for communication with gaming machine 102A, or a custom communication protocol. In gaming machine 102A, message display 118 may be coupled to the frame of the gaming machine or may be inside the cabinet of the gaming machine. However, any association or communication between display 118 and gaming machine 102A may be used as long as display 118 is visible from gaming machine 102A.

Interface 112 is programmed to provide an interactive messaging operation. That is, user message activity, such as touching an active area of display 118 or entering information from keypad 114, causes a response from or action by system 100. One such response is the sending of data over network 126 to another location within system 100 so that a message is displayed. Another response is the display of a menu that depends on the area touched and/or user preferences.

User preferences may be stored in interface memory 146 that is controlled by a CPU 144. CPU 144 controls the sending of messages by gaming location 102, the receipt of messages by gaming location 102 and the display of messages by gaming location 102 in a well known manner.

Game controller 108 is responsible for operation of the gaming machine 102A. Thus the game controller may include a microprocessor, memory, game software, and support circuitry to implement a slot machine or other type of game. The display 110 provides displays or other graphics/video used for the play of the game, such as a display of slot machine rotors.

Gaming location 102 also includes a club card reader 150 that can read a MAG number (e.g., a magnetically represented or encoded number) located on a magnetic strip of a club card 152, which may, for example, be a smart card. The MAG number is unique for each player. Card 152 also sometimes bears a player ID number that is human readable, but is not machine-readable. The card reader sends the MAG number to central authority 120, which converts the MAG number to an OCR (optical character recognition) number (e.g., a number that can be optically recognized or scanned). This feature prevents any potential misuse due to fraudulent creation of a bogus club card. Memory 121 maintains a table that correlates OCR numbers with player ID (identification) numbers. An example of misuse prevented or inhibited by converting the MAG number to an OCR number is as follows. The clerks at the stations generally have access to the OCR numbers, but not the MAG numbers. As a result, a person operating outside system 100 could not duplicate a new player card with a MAG number corresponding to an existing club card. If such a person could duplicate an existing club card, the person may be tempted to use the duplicate card to cash out a player's account. The conversion of the MAG number to an OCR number is a feature that inhibits such temptation.

Central authority 120 translates an OCR number to a corresponding player ID number. This feature allows a single player ID number to identify more than one OCR number. The player ID number can be used by the central authority to address the value of an account corresponding to the player ID number or to access preferences of the player. Thus, the central authority may not maintain or store an account value or preferences corresponding to the MAG number or OCR number; it may only keep an account value and preferences corresponding to the player ID number, correlated with the OCR number by a table or other data structure.

Player preferences may include preferences for drinks, cigarettes/cigars, food, snacks, shows, hotels, rentals, reservations, and the like. In addition, memory 121 may store a preference authorizing the player to be located by having central authority 120 correlate his or her player ID number with the gaming location at which his or her club card 152 was read.

When central authority 120 locates a player, it sends data to station 132 via network 126 that results in an electronic or printed display. For example, a printed display may result in a map 136 printed by a printer 138 attached to the station. Alternatively, the map may be displayed on display 134, for example. The map provides a floor plan of the casino or other facility in which system 100 is located, the location of the service station and the location at which card 152 was entered in a card reader, such as gaming location 102.

Club cards are generated by having a player fill out a form and by submitting the form to a clerk at a station that is equipped with a card creator (not shown), for example. Typically, a card creator is located at only one or two work stations, such as service station 132, within a gambling facility. The clerk keys information into the station, and the information is transmitted to central authority 120, which then generates an OCR number, corresponding MAG no. and player ID number for the creation of a new club card. The OCR number and player ID number are stored in the data base in memory 121 in the manner previously described. The central authority then causes the card creator to create a new club card with the stored player ID number and MAG number. Thus, the OCR number is not stored in memory 121 by having the new club card read by a card reader. Once the MAG, OCR and player ID numbers are created, they cannot be changed by a person operating outside system 100.

Central authority 120 includes a central processing unit (CPU) 122 that operates through a network interface 124 and a network 126 to enable communication of the preferences with gaming locations 102, 104 and 106. Network 126 may be a conventional local area network, which allows messages to be sent directly between any of gaming locations 102, 104 and 106, service station 132 and central authority 120. Memory 121 also may store data for Various displays shown in FIG. 2, for example. Alternatively and/or in addition, data for the displays may be stored locally in the memories for each of the gaming locations, such as memory 146. In certain embodiments, central authority 120 may be divided among a plurality of computing systems, for example.

Service stations, such as station 132, connect to central authority 120 and gaming locations 102, 104 and 106 over network 126. Service station 132 includes an interface similar to interface 112, a touch screen display 134 similar to display 118 and a keypad 114B similar to keypad 114, as well as a communication unit 135 similar to unit 119. Service stations may be located near a source of drinks and snacks, for example, that may be ordered by players or users of system 100. Several stations, like station 132, may be scattered throughout a large gaming facility.

Figure 2:
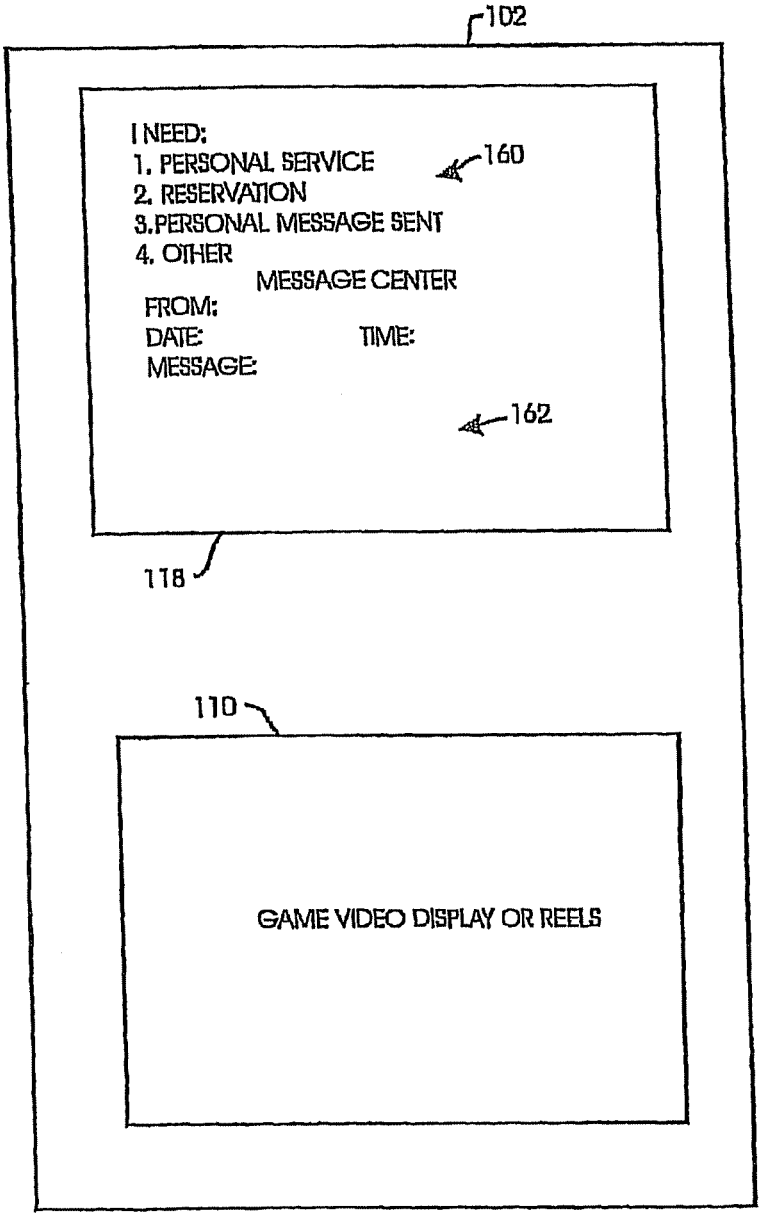
FIG. 2 is a block diagram of one of the gaming location message displays shown in FIG. 1, together with a game video display.

FIG. 2 illustrates message display 118 in relationship to game display 110. Display 118 illustrates an exemplary menu of options 160 for a player or user of system 100, as well as an exemplary space for transmission and/or receipt of messages 162. Display 118 may be implemented as a window in display 110, for example. Display 118 may be used to provide information to players for account access, game play, reservations (e.g., automobile, airline, theater, restaurant, hotel, tour, etc.), messaging, assistance, and/or emergency, for example. Display 118 may be used to receive personal and/or broadcast/multicast messages 162 at a gaming machine, for example. Display 118 may be used to compose and send personal and/or broadcast/multicast messages 162, for example.

Figure 3:
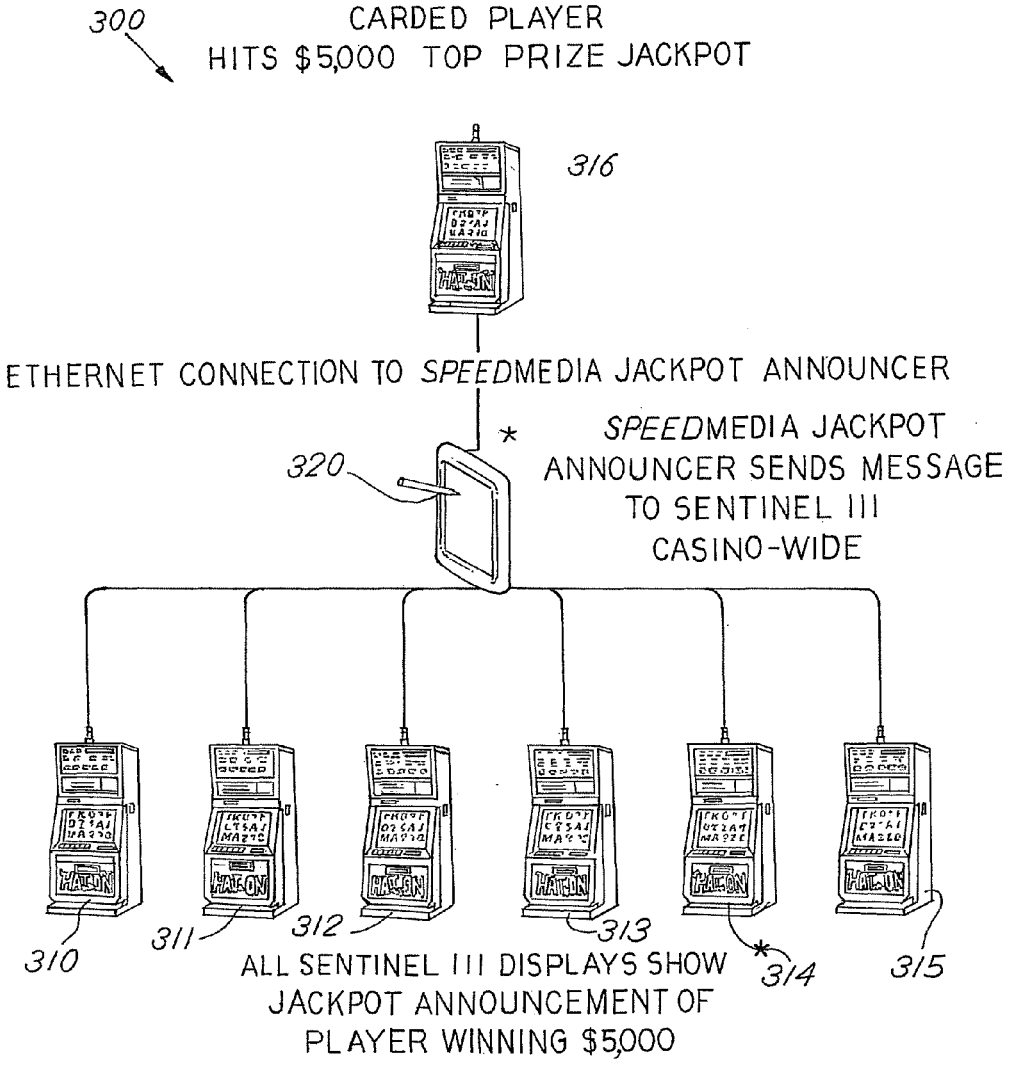
FIG. 3 illustrates a gaming system in accordance with an embodiment of the present invention.

FIG. 3 illustrates an embodiment of a gaming system 300 including a plurality of gaming locations 310-316 and a jackpot announcer 320. The gaming locations 310-316 and the jackpot announcer 320 are connected via one or more interconnected networks, such as an Ethernet network. Gaming locations 310-316 may be similar and/or distinct from gaming locations described above, for example.

In certain embodiments, the system 300 monitors the gaming locations 310-316 in the system 300. For example, the system 300 may include a central authority and/or other external or internal system to monitor activity at the gaming locations 310-316 in the system 300. Central authority 120 may be adapted for this purpose. In certain embodiments, the gaming system 300 may encompass a single gaming environment, such as a casino, or multiple gaming environments, such as a plurality of related casinos (e.g., Harrahs casinos). Events may be detected at one or more gaming locations 310-316, such as bonus awards, jackpots, and the like. Central authority 120 is adapted to permit the operator to configure the jackpot announcement feature according to the present invention.

A display, such as display 118 and/or display 110, may be used to display events such as bonus awards, jackpots, etc., detected in the gaming system 300. Gaming system 300 and jackpot announcer 320 may be configured to disseminate some or all messages based upon one or more trigger and eligibility criterion, including certain defined announcement client groups, such as a denomination group (e.g., announce dollar jackpots to only $1 players), a player's group (e.g., a rating group, points group, etc.), a group of related players (e.g., family, junket, etc.), and/or the like. Eligibility criteria, such as a group of eligible players, may be manually set by an operator and/or automatically based on comparison of player information to a set of one or more criterion including denomination played, game(s) played, ratings or points earned, player relation, location, etc. Eligibility may also be configured from a menu of selectable options.

The jackpot announcer 320 informs players at gaming locations 310-316 and/or other points in the gaming system 300 of events meeting one or more trigger announcement criterion. For example, the jackpot announcer 320 may inform eligible players of selected attendant-paid and/or other jackpots being won through the gaming environment (e.g., a casino), for example. As another example, the trigger may be a jackpot on a $1 slot machine and the announcement may be issued to all slot players, all players, only dollar slot machine players, the player's family group or a combination of configurable groups, etc. The jackpot announcer 320 may inform players through primary and/or secondary displays and/or speakers incorporated in the gaming locations 310-316 and/or through other displays or screens positioned in the gaming environment (e.g., overhead and/or other displays separate from gaming machine displays. One or more announcement criterion may include a threshold award amount, an award type, a denomination, a gaming type, and/or a location, for example.

In certain embodiments, software may be used to configure announcements in the system 300. For example, a "setup wizard" may be provided to configure announcements. The set up wizard may be configured as a menu which issues or provides step-by-step prompts to walk the operator through the set up process to configure the desired award, date and time for the promotion to begin, funding of the award, award level(s), eligible group dynamics and the like.

Announcement configuration information may include machine setup, for example. Machine setup may allow a user to select from one or more machine criteria, such as machine style (e.g., Reel, Video Reel, Video Poker, etc.), denomination, slot manufacturer, location, and/or entire casino floor. In certain embodiments, a user may configure an announcement to show the machine name and/or slot number during the announcement. Alternatively and/or in addition, machine information may be automatically configured for an announcement based on one or more rules and system information, for example.

Announcement configuration information may include jackpot and/or other award setup information, for example. Jackpot setup may allow a user to set one or more thresholds, for example. For example, a jackpot of $500 or more would trigger an announcement on penny machines while a jackpot of $1200 or more would trigger an announcement on quarter, fifty cent, and dollar games. Multiple announcements may be created due to the possibility of multiple triggers and announcement client groups. In certain embodiments, a user may configure an announcement to show the jackpot amount. Alternatively and/or in addition, jackpot information may be automatically configured for an announcement based on one or more rules and system information, for example.

Announcement configuration information may also include player setup information, for example. A user may select to display player names, player nicknames, player numbers, associated groups, etc., and/or an anonymous message as part of the jackpot announcement. Alternatively and/or in addition, player information may be automatically configured for an announcement based on one or more rules and system information, for example.

Announcement configuration information may also include general or universal information, for example. For example, a general announcement may be shown to every machine on a gaming floor and may be set for jackpots equal to or greater than a configurable amount.

Several events and/or other announcement criterion may be used to trigger a jackpot and/or other award announcement. For example, a jackpot may trigger an announcement. When a hand-paid jackpot, for example, has been awarded, an announcement may be viewed on a gaming location display based on criteria established for the announcement, as described above.

A shared jackpot may also trigger an announcement. For example, when a carded top award jackpot is hit, a second jackpot of the same value is divided among a configurable set of carded players. Once the "shared jackpot" has been dispensed to the players, a notification will appear on the display displaying a congratulations message and the amount won. The announcement or notification may be directed to a specific players group, player interest, machine bank, and/or machine type, for example.

A personal jackpot, such as a Bonus Bucks jackpot, may also trigger an announcement. A Bonus Bucks jackpot, such as an Aristocrat SpeedMedia Bonus Bucks jackpot, is a personal jackpot that is accumulated as a percentage of coin-in by a carded player to a shared pot of all carded players. The coin-in percentage is configurable and is system-wide, while the community pot can be divided by Player rankings, player groups, player interest, geography, etc. If a carded player is playing and wins the top prize on the gaming location (ex. $1000 on a standard $0.25 video poker machine), then he/she will win both the main prize and his/her share of the Bonus Bucks jackpot. The amount then resets to zero, and the pot starts accumulating again.

In certain embodiments, after a carded jackpot has been won, a configurable "Splashdown. Countdown" may occur. A timer appears on a gaming location display (such as display 118) notifying the carded player, players group, machine bank, and/or carded players on a specific machine type that they have a configurable amount of time to hit another jackpot in order to get the "Splashdown" bonus. The bonus may consist of a set jackpot amount, bonus points, promo credits, and/or bonus point multiplier, for example. In certain embodiments, a manually and/or automatically selected number of eligible machines participates in the Splashdown Countdown, and a gaming device and/or other controller tests for a jackpot trigger to award the Splashdown bonus within a certain period of time.

In certain embodiments, when a jackpot, such as a Bonus Bucks jackpot, hits, then all of carded players on the same machine bank and/or configurable machine group (i.e., Bonus Points Machine Group Setup) will win a fixed promotional credit award, such as SpeedMedia Promo Bucks, on their machines. The promo credit award amount can also be set up using tiered rankings. For example, a "Platinum" player may get $100 in promo credits while "Bronze" player may receive $10 in promo credits. In certain embodiments, promotional credits are similar to Aristocrat PersonalBanker promo credits. The promo credit can not be uploaded to the player's card and/or the credits cannot be cashed out, for example. In certain embodiments, promo bucks may be configured to set a time limit for bonus points such that, in addition to a Promo Buck award, carded players are notified via a display that they will be receiving bonus points for the next X minutes as well.

In certain embodiments, a jackpot announcement may be related to a random winner feature. For example, once a user has successfully run a random winner option, a random player will be notified, such as by display 110 at gaming location 102. The notification announcement may be configured as described above.

In certain embodiments, when a carded jackpot has been won, the jackpot triggers a randomizer engine. The engine will then randomly select a winner from a configurable group of players and/or machines. An eligible group of players and/or machines may be selected manually by a user and/or automatically according to system information and one or more sets of rules, for example. From that location, the engine may select another random carded player for another prize (i.e., a ricochet reward). This action may continue until a set amount of ricochets has been met. The random prizes awarded may be a jackpot (random amount), bonus points (random amount), bonus point multiplier (random amount), and/or promo credits (random amount), for example. The number of random ricochets, the jackpot amount, bonus point amount, promo credit amount, player group, and the selected game locations are configurable options, for example. A trigger to begin and/or to propagate a ricochet reward may be based on one or more criterion including coin-in (e.g., for a particular machine and/or total for a gaming environment), coin-out (e.g., for a particular machine and/or total for a gaming environment), etc., for example.

Reports may be generated based on jackpot wins and jackpot announcements. A report may include, for example, a creation date, a user identification, an announcement name, a trigger jackpot amount, a game location criterion/criteria, player criterion/criteria, etc. For example, a Bonus Bucks report may include a Player ID, Player Name, slot number, amount of top award won, and amount of bonus bucks received. A Promo Bucks report may include Player IDs and names of carded players receiving the Promo Bucks, the Player ID and name of the winning player, the promo amount won, and associated tiered ranking the award process may be verified. In certain embodiments, a user may run a report by calendar and/or gaming date and may sort the report by any of the multiple fields. Reports may also include information regarding game play, coin-in, coin-out, jackpot or bonus award, etc., before and/or after an announcement, for example. Report data may be transmitted, stored, and/or processed for summary, trending, accounting, and/or other statistics, for example.

Figure 4:
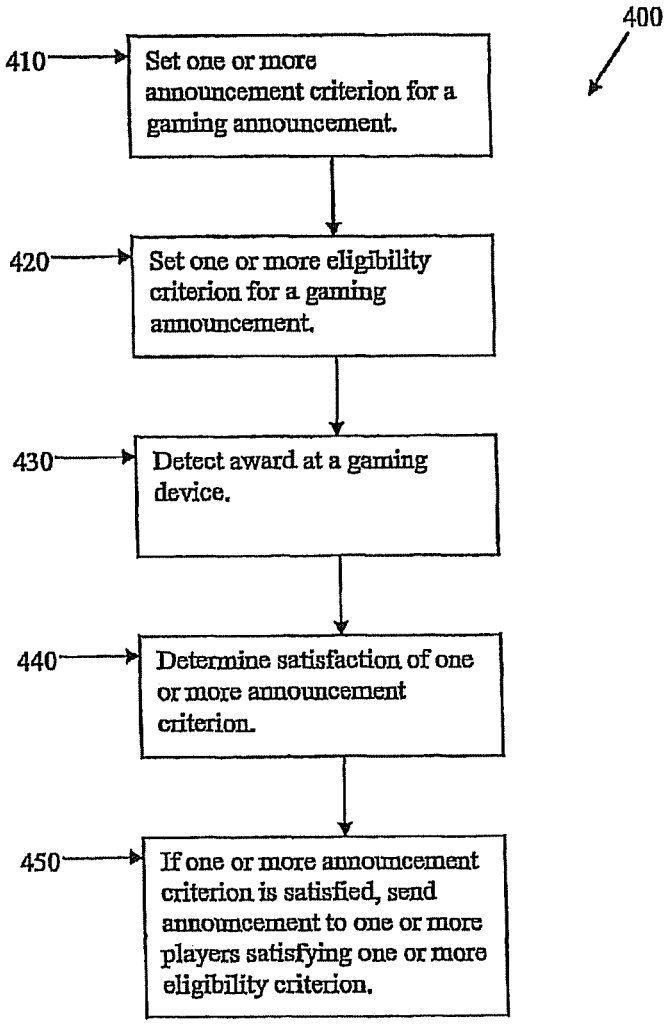
FIG. 4 illustrates a flow diagram for a method for disseminating information in a gaming environment in accordance with an embodiment of the present invention.

FIG. 4 illustrates a flow diagram for a method 400 for disseminating information in a gaming environment in accordance with an embodiment of the present invention. At step 410, one or more announcement criterion is set for a gaming announcement. For example, announcement criteria/criterion may include a game result, a prize award (such as a jackpot, bonus and/or other prize award), a time, a location, a game type, a machine number, and/or the like. One or more announcement criterion may be set by a user, a regulatory agency, a content provider, a gaming establishment, and/or automatically by one or more rules, for example.

At step 420, one or more eligibility criterion is set for a gaming announcement. For example, eligibility criteria/criterion may include one or more players or groups of players satisfying a particular denomination, game, rating, points, relationship, location, and/or the like. One or more eligibility criterion may be set by a user, a regulatory agency, a content provider, a gaming establishment, and/or automatically by one or more rules, for example. One or more eligibility criterion defines an intended audience for a gaming announcement, for example. An announcement system may use the one or more eligibility criterion in conjunction with the one or more announcement criterion and/or other rules/parameters to determine when, where, how and/or to whom to send an announcement message, for example.

At step 430, a jackpot awarded at a gaming device is detected. For example, a jackpot announcer and/or other gaming system or controller may monitor activity in a gaming environment to detect a triggering jackpot award event and/or other prize event. Gaming activity may be directly monitored from gaming devices and/or from accounting and/or player tracking data collected from gaming devices, for example.

At step 440, satisfaction of one or more announcement criterion is determined. For example, the jackpot award and/or other event is compared to the one or more announcement criterion to determine if one or more of the announcement criterion are satisfied.

At step 450, if one or more announcement criterion is satisfied, then a gaming announcement is sent to one or more players satisfying one or more eligibility criterion. The announcement package to be sent to the configured group of announcement clients may be configured as well. It may include pre-programmed audio and video including text messages, audio and video celebration content and the like. Each configured announcement may include a different message package. Based on satisfaction of one or more announcement criterion, notification of the jackpot award and/or an opportunity for further award(s) and/or bonus play, for example, may be transmitted to one or more players or groups of players satisfying one or more eligibility criterion. Eligible players may then participate in the opportunity provided in the announcement, for example. For example, players may move to eligible machines for bonus or extra incentive game play. Players may elect to participate in a special bonus game or jackpot competition as indicated in the announcement, for example. Players may opt into tournament play as indicated in the announcement, for example.

One or more of the steps of the method 400 may be implemented alone or in combination in hardware, firmware, and/or as a set of instructions in software, for example. Certain embodiments may be provided as a set of instructions residing on a computer-readable medium, such as a memory, hard disk, DVD, or CD, for execution on a general purpose computer or other processing device.

Certain embodiments of the present invention may omit one or more of these steps and/or perform the steps in a different order than the order listed. For example, some steps may not be performed in certain embodiments of the present invention. As a further example, certain steps, may be performed in a different temporal order, including simultaneously, than listed above.

While certain embodiments described above discuss a jackpot, certain embodiments also extend to other awards, prizes, bonuses, coupons, promotional credits, and/or other extra opportunities in a gaming environment.

Thus, certain embodiments provide adaptive, programmable systems and methods for disseminating information in a gaming environment. Certain embodiments provide additional gaming and/or award opportunities to eligible players following a triggering event. Certain embodiments provide a technical effect of automated announcements and bonusing in a gaming environment based on preset criteria.

Figure 5:
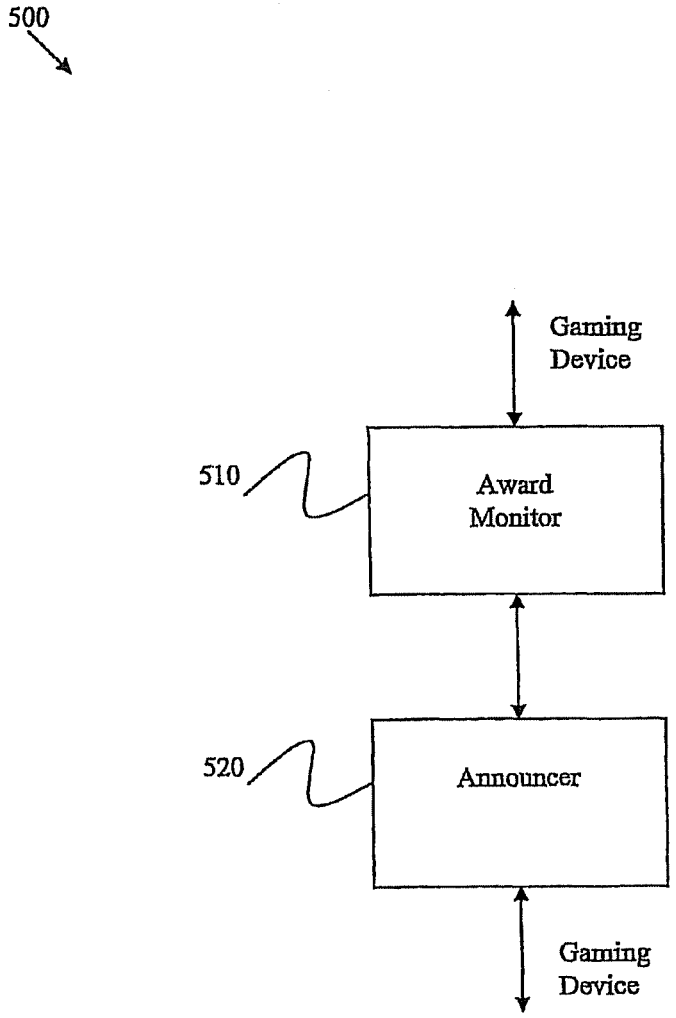
FIG. 5 illustrates an exemplary system for monitoring gaming awards and generating announcements in accordance with an embodiment of the present invention.

Certain embodiments of the systems and/or methods described above may be implemented using a system, such as the exemplary system 500 shown in FIG. 5, that monitors gaming awards and generates announcements in accordance with an embodiment of the present invention. The system 500 is in communication with one or more gaming devices for play by players. The system 500 includes an award monitor 510 configured to detect an award at a gaming device in the gaming system. The award monitor 510 determines satisfaction of an announcement criterion by the award. The system also includes an announcer 520 transmitting, upon satisfaction of the announcement criterion, an award announcement to a group of one or more players satisfying an eligibility criterion.

The systems and/or methods described above may also be implemented as a computer-readable medium having a set of instructions for execution on a processor. The set of instructions includes an award monitoring routine configured to detect an award at a gaming device. The award monitoring routine determines satisfaction of an announcement criterion by the award. The set of instructions also includes an announcement routine transmitting, upon satisfaction of the announcement criterion, an award announcement to a group of one or more players satisfying an eligibility criterion.

In certain embodiments, referring back to FIG. 2, using a personal identification number (i.e., a "PIN"), a player may be directed to a menu offering banking or casino credit account functionality, such as Aristocrat PersonalBanker®, and/or other services/amenities, such as Aristocrat SpeedMedia™ Butler. Using an account access or management menu, a player may retrieve various information and/or perform various account-related tasks. For example, a player may retrieve a credit balance via the menu. A player may convert loyalty points and/or other points to cash/credit at the gaming location. Additionally, a player may upload and/or download cashable credits at the gaming location.

If amenities are selected, a new menu screen is displayed and/or additional options are displayed on the current menu screen, for example. Based on certain criteria, which may be set in via a manager or configuration application (e.g., specific player rankings, time, date, location, player identification, player type, game type, gaming device type, etc.), the screen may show one or more of the following options: Redemption, Service, and Host, for example. That is, a player may use the interface to link to a bank or credit account. A player may also access a menu of options to redeem points, comps, cash and/or prize. A player may also access a service screen to input a valet ticket number, order food or drink from a menu, make dinner reservations, order theater tickets, etc. In certain embodiments, a hostess station may be designated by a player and/or automatically by the system to fulfill a service request. A player may also access a host menu to page or request a host, for example.

If Redemption is selected, the player may select a prize or comp option, for example. Once the player has selected an option, the interface system searches a current system inventory to display what prizes or comps are available based on the current point/comp balance. The player may then select a quantity of an item (e.g., a meal for two people at a Casino Café) and, if enough points/comps are not available for the transaction, an error message is displayed telling the customer of the deficiency. In certain embodiments, a customer may be allowed to add and/or purchase additional points or credits to complete the transaction. If the customer has enough points/comps for the transaction, then the screen displays a review of the transaction and asks for a confirmation. If "YES" is selected, for example, then the prize/comp ticket is printed, such as by ticketing printer at the gaming location. If "NO" is selected, for example, then the display returns to a previous or default screen.

By selecting Service, the player is given the options of "COCKTAILS" or "VALET", for example. If a "COCKTAILS" (or "FOOD" or "BEVERAGE" or other similar indicator) option is selected, the player may order from a drink and/or food menu. The information is then transmitted to a client application placed in a cocktail station where a waiter/waitress sees the order and brings the drink and/or food to the customer. In certain embodiments, cocktail service client application may be divided into sections based on bar stations, for example. The client application may display a graphical presentation of the gaming environment (e.g., a casino floor), with the ordering gaming location highlighted or otherwise identified on the display. The screen may show an area, slot number, machine name and drink order, for example. Also, the client application may store drink history, so, if the player orders drinks again from the service menu, the drink of choice will show up on the menu along with the other options.

When "VALET" is chosen from the service menu, the player may input a valet ticket number using the touch screen keypad, and a signal is sent to a client application at a valet station. Once a valet employee receives the number, he/she verifies the signal and retrieves the car so that the car is waiting when the customer arrives. In certain embodiments, the valet application may store the sent and received date/times so management can run reports to evaluate the efficiency of the valet staff.

In certain embodiments, other options may be made available on the service menu to provide gaming and/or other services to a player.

If a Host menu is selected, for example, the player may input a page or text message to contact a host. The interface facilitates transmission of a page, a cellular phone text message, and/or an electronic mail to one or more hosts in the gaming environment. The message may include player location and information, such as player id, player name, slot number, and assigned host, if applicable. If the assigned host is on duty, he/she can go see the customer. If the host is not on duty or there is not a host assigned, any of the messaged hosts can visit the customer. In certain embodiments, a player may transmit messages to other gaming environment personnel and/or patrons using a messaging menu and/or service, for example.

In certain embodiments, a points/comps redemption generates a ticket and/or record including information for accounting/auditing purposes. The ticket and/or other record includes a system generated redemption id, a description of the prize/comp, and the value of the prize/comp. Once the ticket is printed and/or other record is generated, the ticket/record may appear as a redemption for that player in accounting records, for example. For example, redemption of a comp by a player generates a record resulting in a posting of bonus credits to the player's account. In certain embodiments, a redemptions tab or section of a player account may provide a detailed and/or summary view of point/comp redemptions claimed for that player.

In certain embodiments, reports may be generated based on player menu transactions. For example, "VALET" reports may be run by either calendar date or gaming date. Sent date/time and client application confirmed date/time may be displayed along with user system ID, for example. Redemptions may be logged in a detailed and/or summary redemption report, for example. Player interface redemptions may be displayed as a separate inventory category with corresponding transactions, for example.

FIGS. 6-22 provide some additional examples of menus and features that may be provided in a menuing system at a gaming location or other terminal.

Figure 6:
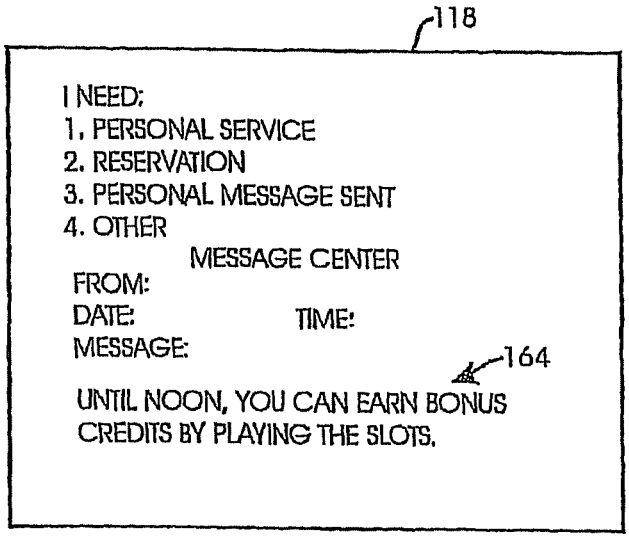
FIG. 6 is a block diagram of the message display shown in FIG. 1 with an exemplary service menu, including a personal service option, a reservation option and a personal message option, and a message menu with a displayed advertisement.

FIG. 6 illustrates display 118 with an exemplary advertisement 164. Any type of advertisement may be generated by central authority 120 and sent to any gaming location for display. FIG. 6 also shows an exemplary menu by which a user may chose the type of service desired by touching an appropriate portion of display 118 or entering a corresponding number on keypad 114. In certain embodiments, the advertisement 164 may be displayed without the menu if desired.

Figure 7:
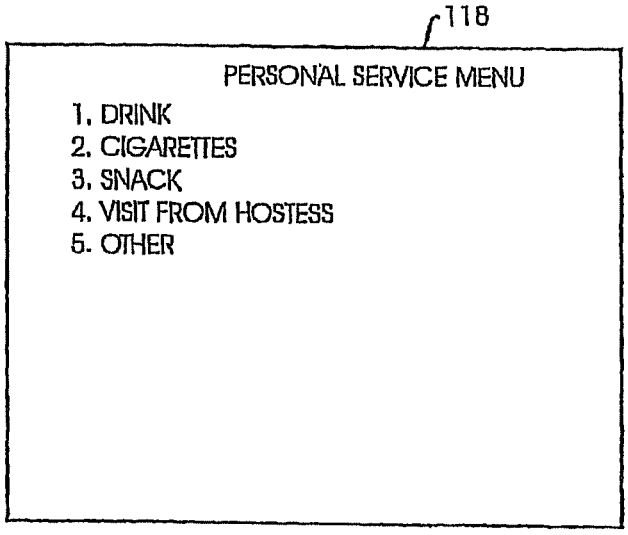
FIG. 7 is a block diagram of the message display shown in FIG. 1 with a personal service menu, including a drink option, displayed in response to the selection of the personal service option shown in FIG. 6.

FIG. 7 illustrates display 118 with an exemplary personal service menu displayed in response to a player or user touching the term "PERSONAL SERVICE" on display 118 or entering the number 1 on keypad 114, for example. The items in the personal service menu may depend on the preferences accessed from memory 121 when the user's club card is read by reader 150. For example, a smoker whose preferences include cigarettes will have item 2 "CIGARETTES" displayed, whereas a non-smoker whose preferences do not include cigarettes will not have item 2 displayed.

Figure 8:
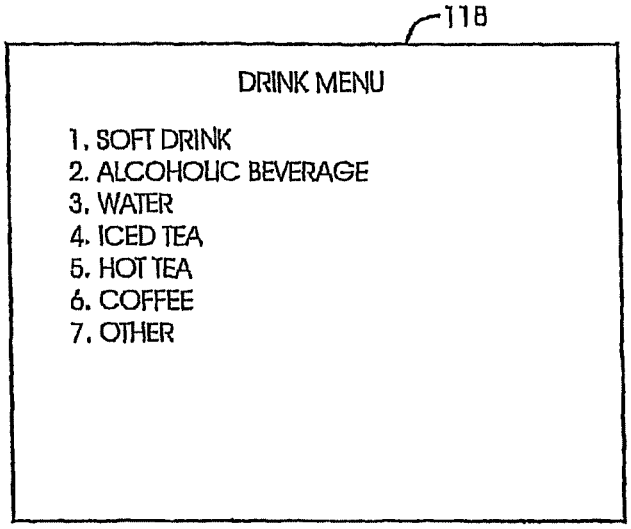
FIG. 8 is a block diagram of the message display shown in FIG. 1 with a drink menu, including a soft drink option, displayed in response to the selection of the drink option in FIG. 7.

FIG. 8 illustrates an exemplary drink menu displayed in response to a player or user touching the phrase "DRINK" on the display shown in FIG. 7, or entering the number 1 on keypad 114. The drinks displayed may depend on the player preferences accessed from memory 121.

Figure 9:
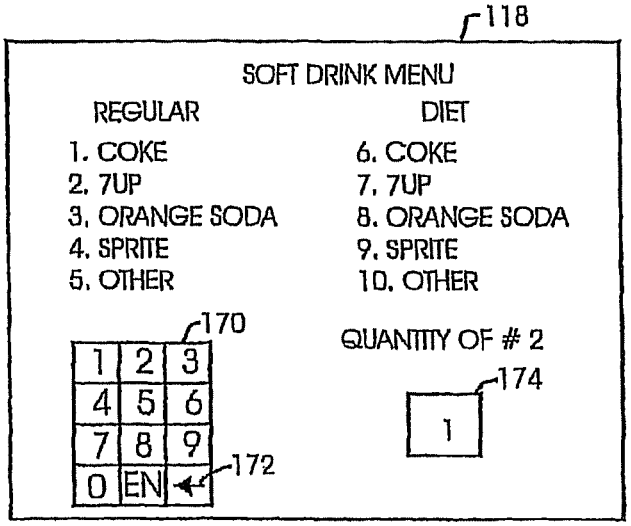
FIG. 9 is a block diagram of the message display shown in FIG. 1 with a soft drink menu displayed in response to the selection of the soft drink option in FIG. 8, including an image of a touch screen numerical keypad for entering quantity.

FIG. 9 illustrates an exemplary soft drink menu displayed in response to a player or user touching the screen 118 at the phrase "SOFT DRINK" on the display shown in FIG. 8. The listed drinks may depend on the player preferences accessed from memory 121. When a player selects a particular drink from the FIG. 9 display by touching display 118 at the text corresponding to the desired drink, a numeric input image, such as an image of a numeric keypad 170, is displayed as shown. In this example, it is assumed that the player touched "7UP" by the number 2 or touched the number 2. The text "EN" provides an enter function and an arrow 172 provides a backspace function. Other forms of a numeric input image may be displayed. A box 174 displays the number entered by the player from keypad image 170. The number indicates the quantities of drinks desired by the player. Each of displays 118, 118A and 134 can display a numeric input image like image 170.

Communication unit 119 generates a message identifying the drink selected by touching display 118 (e.g., drink number 2) and the quantity selected by touching a number on the keypad image 170 (e.g., the number 1). The message is transmitted via controller 148 and network 126 to service station 132 and is displayed on message display 134.

FIG. 10 illustrates an exemplary reservation menu displayed on display 118 in response to a player or user touching the phrase "RESERVATION" or the number 2 on the display shown in FIG. 6, or by entering the number 2 on keypad 114. The message display includes graphics images in the form of a pair of masks 200, a cake 202 and a car 204. The graphics images may be in color. For example, masks 200 may be displayed in red, cake 202 may be displayed in yellow, and car 204 may be displayed in blue. Many other forms of graphics images can be used to illustrate the text appearing on any of the displays described in this specification. Alternatively, the graphics images can be shown alone without any text.

FIG. 11 illustrates an exemplary show ticket reservation menu displayed on display 118 in response to a player or user touching the phrase "TICKET FOR SHOW" or the number 1 on the display shown in FIG. 10, or by entering the number 1 on keypad 114. The items listed in FIG. 11 may depend on the player's preferences stored in memory 121, for example.

FIG. 12 illustrates an exemplary comedy reservation menu displayed on display 118 in response to a player or user touching the phrase "COMEDY" or the number 1 on the display shown in FIG. 11, or by entering the number 1 on keypad 114. The items listed may depend on the player's preferences stored in memory 121, for example.

Figure 14:
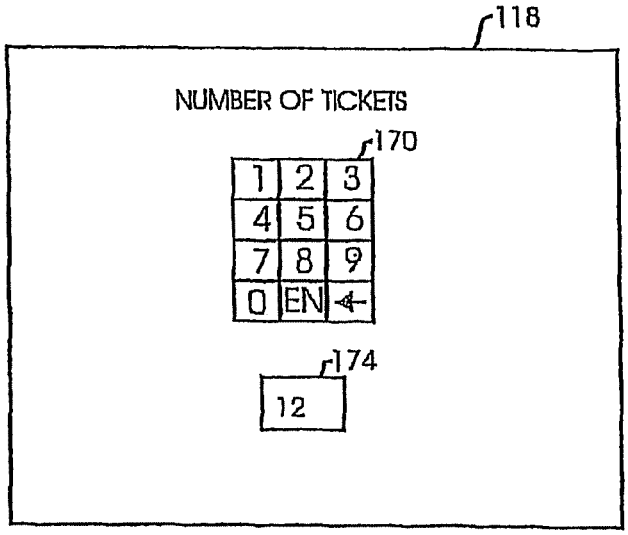
FIG. 14 is a block diagram of the message display shown in FIG. 1 with an image of a touch screen numerical keypad displayed in response to selection of the "other" option of FIG. 13.

FIG. 13 illustrates an exemplary show x reservation menu displayed on display 118 in response to a player or user touching the phrase "SHOW X" or the number 1 or the number 2 on the display shown in FIG. 12, or by entering the number 1 on keypad 114. The user enters the number of tickets desired in the blank space provided by using keypad 114 or by touching the appropriate number below the legend "NUMBER OF TICKETS." If the desired number of tickets is not displayed, the player touches "OTHER" in order to display the image of numeric input keypad 170 as shown in FIG. 14. The player then enters the desired number of tickets by touching an appropriate combination of numbers on image 170. Box 174 displays the number entered by the player.

Communication unit 119 generates a message identifying the desired show, date(s), time(s) and number of tickets indicated by the player's touching of display 118 as described in connection with FIGS. 10-14. The message is transmitted via controller 148 and network 126 to service station 132 and is displayed on message display 134. Alternatively, the message may be sent to a ticket handling facility 158 of a producer or ticket agent of the requested show via a network 159, such as the Internet through central authority 120.

Figure 15:
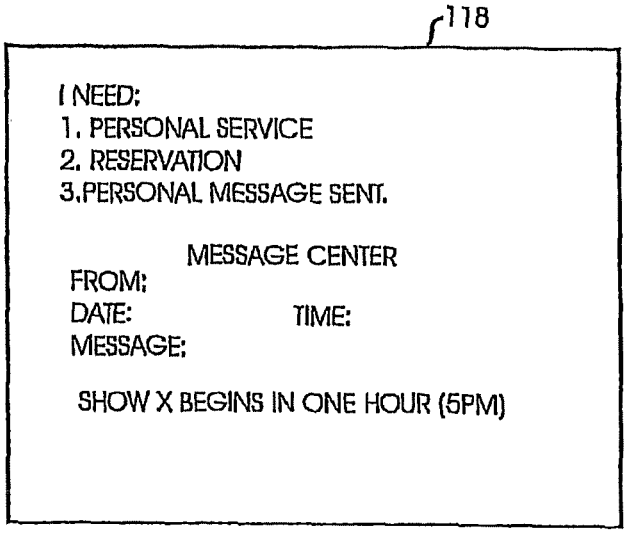
FIG. 15 is a block diagram of the message display shown in FIG. 1 with a reminder message displayed in response to selection of the show x reservation selection shown in FIG. 13.

FIG. 15 illustrates an exemplary reminder message sent to display 118 from central authority 120 or station 132. For example, a reminder message may remind a player regarding an upcoming showtime (for which the player may or may not already have a reservation), an upcoming meal, an upcoming promotion or bonus play, a food or drink order confirmation, etc. The message may be a displayed reminder and/or may provide a user with an opportunity to confirm or respond, for example.

FIG. 16 illustrates an exemplary personal message menu displayed on display 118 in response to a player or user touching the phrase "PERSONAL MESSAGE SENT" or the number 3 on the display shown in FIG. 6, or by entering the number 3 on keypad 114. When the player touches any of numbers 1-3 shown in FIG. 16, or touches the text opposite the numbers, an alphanumeric input image, such as an image of an alphanumeric keypad 180, is displayed on display 118 as shown in FIG. 17. Arrow 182 represents a backspace function, the word "ENTER" represents an enter function. The word "SHIFT" represents a shift function between upper case and lower case letters. The punctuation marks shown in image 180 have their normal meanings.

The player causes controller unit 119 to generate an appropriate message by entering the name of a person for whom the message is intended (e.g., John Doe), a game location (e.g., 106) or player ID number, and a message, such as "MEET ME AT THE RESERVATION DESK AT NOON," by touching display 118 at the appropriate numbers and letters of image 180. The data entered by the player is displayed as shown in FIG. 17. Each of displays 118, 118A and 134 can display an alphanumeric input image like image 180. Alternatively, the message shown in FIG. 17 may be typed by the player or user by operating keypad 114.

Communication unit 119 generates a message based on the data entered by the player as explained in connection with FIG. 17. The message includes an identification of the gaming location (e.g., 106) to which the message is to be sent or a player ID number. The message is transmitted via controller 148 and network 126 to central authority 120. If a player ID number was entered, central authority 120 checks the ID numbers of players whose cards have been read by the system to find a match. If a match is located, the message is forwarded to the gaming location at which the card was read. If no match is found, the system stores the message in memory 121. When the player with the correct ID number inserts his card into a reader, the message is retrieved from memory and is forwarded to the proper gaming location for display. In addition, central authority 120 finds the name of the current user of gaming location 102 from the information on the club card 152 used to initiate the gaming location so that the name of the sender can be displayed at the gaming location receiving the message. If a gaming location was entered by the player, central authority sends the message to the proper gaming location, such as location 106, and displays on display 118A the name of the sender, the date, the time the message was sent and the message as shown in FIG. 18.

FIG. 18 illustrates the an exemplary message menu displayed on display 118A of gaming location 106 showing the message sent from gaming location 102 to gaming location 106 over network 126 through central authority 120. If a gaming location is entered by the player as explained in connection with FIG. 17, the message may be sent directly from gaming location 102 to gaming location 106 without being transmitted to the central authority 120. The date and time at which the message was sent are displayed as shown in FIG. 18.

The player at gaming location 106 may reply to the message shown in FIG. 18 by touching display 118A at the "REPLY" text, at the number 4 to the left of the reply text, or by entering the number 4 on keypad 114A, for example.

FIG. 19 illustrates an exemplary reply message menu displayed on display 118A in response to a player or user touching the phrase "REPLY" or the number 4 on screen 118A or by entering the number 4 on keypad 114A. The reply menu provides for sending copies of the message to various locations. The personal message menu shown in FIG. 16 can be modified to also provide for sending of copies.

A reply message is generated and sent in the same manner described in connection with FIGS. 16 and 17. When the player touches any of numbers 1-3 or the text opposite any of the numbers, a display of the type shown in FIG. 17 is generated on display 118A, for example. The player then enters the reply data using image 180 as previously described.

FIG. 20 illustrates exemplary messages received at service station 132 and displayed on display 134 from gaming locations 102 and 104. In response to such messages, workers in the gaming facility may attempt to fill the order and bring it to the player or user. The location of the requester of service is displayed to help facilitate delivery. The time is posted to help ensure that orders are processed in the order in which they were sent, for example.

FIG. 21 illustrates an exemplary service station reply message menu displayed in response to a work station attendant touching the phrase "REG. COKE" on the display 134 shown in FIG. 20, or entering the number 1 on keypad 114B. The attendant can enter a message by touching the number 2 or touching the phrase "CONTENT OF MESSAGE" shown in FIG. 21 which causes display of an alphanumeric input image on display 134 like the image shown in FIG. 17. A message then is entered in the manner described in connection with FIG. 17. For example, the message may be "WE ARE OUT OF REGULAR COKE. IS A DIET COKE OK?" By enabling interactive communication between a gaming location and a service station, the delivery of desired goods to gaming locations is facilitated.

Figure 22:
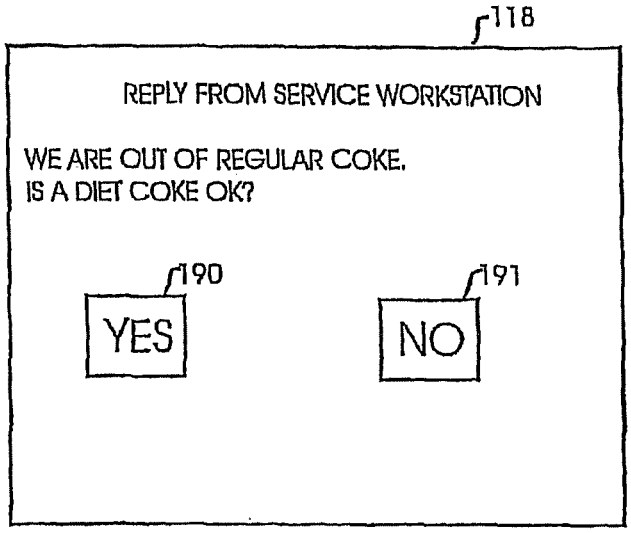
FIG. 22 is a block diagram of the second message display shown in FIG. 18 illustrating delivery of a message from the service center and providing for a yes or no response.

Communication unit 135 generates a message based on the data entered by an attendant as explained in connection with FIGS. 17 and 21. The message includes an identification of the gaming location (e.g., 102) to which the message is to be sent. The message is transmitted via a serial controller in service station 132 and network 126 to gaming location 102 and is displayed on display 118 as shown in FIG. 22.

The message from the service center is displayed with a YES button 190 and a NO button 191. The player at gaming location 102 responds to the message by touching display 118 at either the word "YES" or "NO." Communication unit 119 generates a message based on the touching of button 190 or 191. The message includes an identification of service station 132 to which the message is to be sent. The message is transmitted via serial controller 148 and network 126 to service station 132 and is displayed on display 134 so that an attendant will know the drink preferred by the player.

Those skilled in the gaming and computer arts are able to program the interfaces and central authority to provide the displays and interactivity described in the accompanying drawings and described in this specification.

The "OTHER" options referenced in the drawings are handled by displaying a numeric or alphanumeric input image depending on context.

In certain embodiments, a variety of messaging and/or service capabilities, such as the examples described above, may be provided at a gaming location, kiosk or workstation. Content and/or services may be provided using a high-speed delivery system for timely exchange of information and delivery of content. A high-resolution video display may be used to provide advertisements and promotions to customers as well as menu and information display. A touch screen interface allows a customer to easily interact with menu options at a gaming location and provides improved configurability to a gaming establishment. In certain embodiments, multimedia graphics, audio and/or other data may be downloaded to gaming location for presentation and/or use via the touch screen interface.

Figure 23:
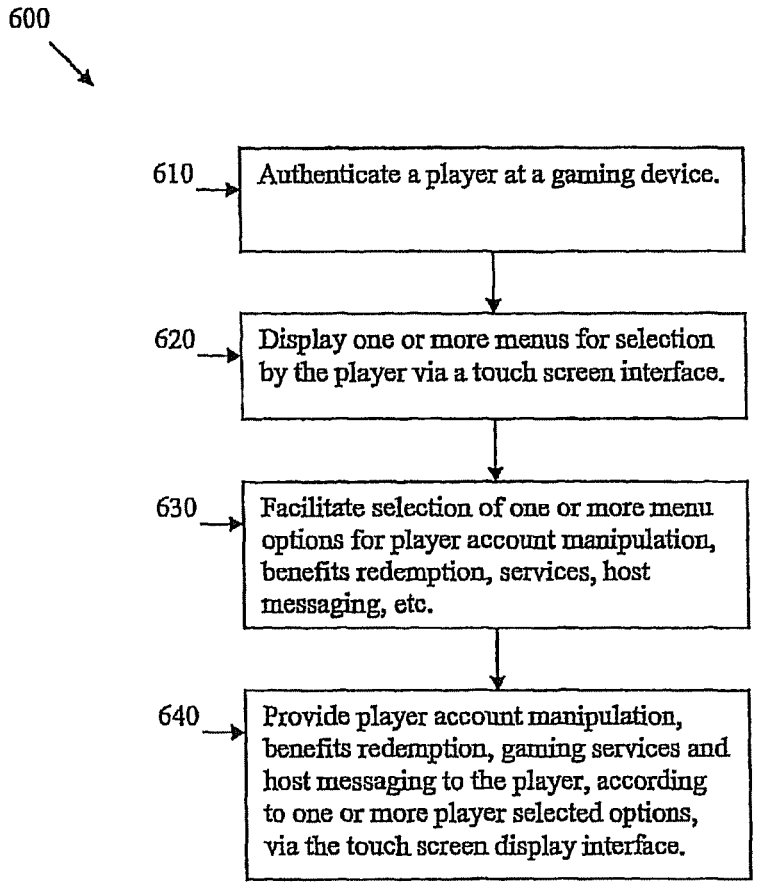
FIG. 23 illustrates a flow diagram for a method for providing information and services to a player in a gaming environment in accordance with an embodiment of the present invention.

FIG. 23 illustrates a flow diagram for a method 600 for providing information and services to a player in a gaming environment in accordance with an embodiment of the present invention. At step 610, a player is authenticated at a gaming device. For example, the player may be authenticated through insertion and/or scanning of a player card, biometric input (e.g., finger print, eye scan, voice scan), etc.

At step 620, one or more menus are displayed for selection by the player via a touch screen interface. For example, one or more menus relating to player account, benefit redemption, services (e.g., valet, food, beverages, etc.), messaging, etc., may be displayed for selection by the player.

At step 630, selection by the player of one or more menu options is facilitated for player account manipulation, benefits redemption, game services, host messaging, etc. For example, a player may access the touch screen interface to select by touch one or more listed menu options. As another example, a player may select via button, voice command, etc., one or more displayed menu options. In certain embodiments, the touch screen interface may include a game play interface. In other embodiments, the touch screen interface providing menu access is implemented separately from game play functionality.

At step 640, player account manipulation, benefits redemption, gaming services and host messaging are provided to the player, according to one or more player selected options, via the touch screen display interface. Such options are provided apart from gaming functionality at the gaming device, for example.

In certain embodiments, player interaction with the touch screen display interface is recorded for later accounting and auditing access, for example.

In certain embodiments, one or more menu options displayed via the touch screen display interface may be customized according to player data (e.g., identification of the particular player or type of player via a player card).

In certain embodiments, the touch screen display interface may be used to provide messaging between players at different gaming devices, ordering and/or reservation of products and/or services without interruption of game play at the gaming device, interactive access for manipulation by the player of a player account, benefits redemption, services, host messaging, etc.

One or more of the steps of the method 600 may be implemented alone or in combination in hardware, firmware, and/or as a set of instructions in software, for example. Certain embodiments may be provided as a set of instructions residing on a computer-readable medium, such as a memory, hard disk, DVD, or CD, for execution on a general purpose computer or other processing device.

Certain embodiments of the present invention may omit one or more of these steps and/or perform the steps in a different order than the order listed. For example, some steps may not be performed in certain embodiments of the present invention. As a further example, certain steps may be performed in a different temporal order, including simultaneously, than listed above.

The systems and/or methods described above may also be implemented as a computer-readable medium having a set of instructions for execution on a processor. The set of instructions includes a game play interface routine facilitating play of a game at a gaming device by a player. The set of instructions also includes a touch screen interface routine configured to display one or more menus of options to the player at the gaming device. The set of instructions further includes a processing routine in communication with an external system to transmit data to and receive data from the external system. The processing routine operates in conjunction with the touch screen interface to provide a player access to a player account, benefits redemption, services and host messaging based on player selection apart from gaming functionality at the gaming device.

Several embodiments are described above with reference to drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any machine-readable media for accomplishing its operations. As noted above, the embodiments of the present invention may be implemented using an existing computer processor, or by a special purpose computer processor incorporated for this or another purpose or by a hardwired system.

As noted above, embodiments within the scope of the present invention include program products comprising machine-readable media for carrying or having machine-executable instructions or data structures stored thereon. Such machine-readable media can be any available media that can be accessed by a general purpose or special purpose computer or other machine with a processor, such as a processor incorporated into an electronic gaming machine or similar device. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Embodiments of the invention are described in the general context of method steps which may be implemented in certain embodiments by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

Embodiments of the present invention may be practiced in a networked environment using logical connections to one or more remote gaming terminals and/or other computers having processors. Logical connections may include a local area network (LAN) and a wide area network (WAN) that are presented here by way of example and not limitation. Such networking environments are commonplace in office-wide or enterprise-wide computer networks, intranets and the Internet and may use a wide variety of different communication protocols. Those skilled in the art will appreciate that such network computing environments will typically encompass many types of computer system configurations, including personal computers, hand-held devices, multi-processor systems, microprocessor-based or programmable consumer electronics, network PCs, minicomputers, mainframe computers, and the like. Embodiments of the invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An exemplary system for implementing the overall system or portions of the invention might include a general purpose computing device in the form of a computer, including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD ROM or other optical media. The drives and their associated machine-readable media provide nonvolatile storage of machine-executable instructions, data structures, program modules and other data for the computer.

While the invention has been described with reference to one or more preferred embodiments, those skilled in the art will understand that changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. A method of announcing awards in a gaming system having a plurality of gaming devices for play by players and a central authority computing device communicatively coupled to each of the plurality of gaming devices, said method comprising:

configuring, within a memory of the central authority computing device, a plurality of announcement packages including a first announcement package associated with a first event trigger satisfied during play of a gaming device of the plurality of gaming devices, and a second announcement package associated with a second event trigger satisfied during play of the gaming device, wherein the first announcement package includes an announcement of an opportunity to win an additional award;

configuring, within the memory of the central authority computing device, target client eligibility for eligible target clients to receive at least one of the first and second announcement packages, wherein each of the first and second announcement packages includes at least pre-programmed audio and video celebration content that is individually customized based on respective eligible target clients associated with the first and second announcement packages;

detecting, by the central authority computing device, when an event trigger occurs at a gaming device of the plurality of gaming devices;

determining, by the central authority computing device, whether the event trigger satisfies at least one of the first and second event triggers;

upon determining satisfaction of the first event trigger, transmitting, by the central authority computing device, the first announcement package to the eligible target clients eligible to receive the first announcement package, including a first plurality of clients that are clients other than the gaming device at which the first event trigger occurred, thereby announcing the opportunity to win the additional award and displaying the customized, pre-programmed audio and video celebration content associated with the first announcement package to the first plurality of clients; and upon determining satisfaction of the second event trigger, transmitting, by the central authority computing device, the second announcement package to the eligible target clients eligible to receive the second announcement package, including a second plurality of clients that are clients other than the gaming device at which the second event trigger occurred, thereby displaying the customized, pre-programmed audio and video celebration content associated with the second announcement package to the second plurality of clients.

2. The method of claim 1, wherein said at least first or second event trigger corresponds to an award sufficient to trigger an award announcement and an opportunity for an additional award.

3. The method of claim 2, wherein said at least first or second event trigger includes at least one of a threshold award amount, an award type, a denomination, a gaming type, and a location.

4. The method of claim 1, wherein target client eligibility criterion includes at least one of a game denomination, a game type, a player relation, a location, a player rating and a number of points.

5. The method of claim 1, further comprising providing a setup wizard to configure announcements, announcement criterion and eligibility criterion.

6. A non-transitory computer readable media having a set of instructions for execution on a processor, said set of instructions configured to execute a method for announcing awards on a gaming system having a plurality of gaming devices and a central authority computing device communicatively coupled to each of the plurality of gaming devices, the method comprising:

configuring, within a memory of the central authority computing device, a plurality of announcement packages including a first announcement package associated with a first event trigger satisfied during play of a gaming device of the plurality of gaming devices, and a second announcement package associated with a second event trigger satisfied during play of the gaming device, wherein the first announcement package includes an announcement of an opportunity to win an additional award;

configuring, within the memory of the central authority computing device, target client eligibility for eligible target clients to receive at least one of the first and second announcement packages, wherein each of the first and second announcement packages includes at least pre-programmed audio and video celebration content that is individually customized based on respective eligible target clients associated with the first and second announcement packages;

detecting, by the central authority computing device, when an event trigger occurs at a gaming device of the plurality of gaming devices;

determining, by the central authority computing device, whether the event trigger satisfies at least one of the first and second event triggers;

upon determining satisfaction of the first event trigger, transmitting, by the central authority computing device, the first announcement package to the eligible target clients eligible to receive the first announcement package, including a first plurality of clients that are clients other than the gaming device at which the first event trigger occurred, thereby announcing the opportunity to win the additional award and displaying the customized, pre-programmed audio and video celebration content associated with the first announcement package to the first plurality of clients; and upon determining satisfaction of the second event trigger, transmitting, by the central authority computing device, the second announcement package to the eligible target clients eligible to receive the second announcement package, including a second plurality of clients that are clients other than the gaming device at which the second event trigger occurred, thereby displaying the customized, pre-programmed audio and video celebration content associated with the second announcement package to the second plurality of clients.

7. The non-transitory computer readable media of claim 6, further comprising a setup routine for configuring announcements, announcement criterion and eligibility criterion.

* * * * *